United States Patent [19]

Rogove et al.

[11] 4,124,932

[45] Nov. 14, 1978

[54] PREQUENCH COOLING FOR GALVANIZED TUBING

[75] Inventors: Arthur H. Rogove, Cinnaminson, N.J.; Augusto H. Hijuelos, New Lenox, Ill.

[73] Assignee: Allied Tube & Conduit Corporation, Harvey, Ill.

[21] Appl. No.: 829,667

[22] Filed: Sep. 1, 1977

[51] Int. Cl.[2] ..... B23P 17/00

[52] U.S. Cl. ..... 29/527.4; 29/460; 118/69; 266/113; 427/398 B

[58] Field of Search ..... 29/460, 527.4; 427/398 R, 398 B; 118/69, DIG. 11; 266/112, 113, 114; 148/153, 156

[56] References Cited

U.S. PATENT DOCUMENTS

| | | | |
|---|---|---|---|
| 2,094,583 | 10/1937 | Cook et al. | 427/390 R |
| 2,197,622 | 4/1940 | Sendzmir | 118/69 X |
| 2,287,825 | 6/1942 | Postlewaite | 118/69 X |
| 2,771,669 | 11/1956 | Armstrong et al. | 29/460 X |
| 3,274,679 | 9/1966 | Kennedy | 29/460 |
| 3,507,712 | 4/1970 | Scott | 266/113 X |
| 3,524,245 | 8/1970 | Searing | 29/460 X |
| 3,696,503 | 10/1972 | Krengel et al. | 29/527.4 |
| 3,743,535 | 7/1973 | Padjen et al. | 423/398 B |
| 3,768,145 | 10/1973 | Ostrowski | 29/460 X |
| 3,845,540 | 11/1974 | Rossi | 266/3 R X |

*Primary Examiner*—Leon Gilden
*Attorney, Agent, or Firm*—Fitch, Even, Tabin & Luedeka

[57] ABSTRACT

Steel strip is continuously roll-formed into tubular shape, seam-welded and coated with zinc in a galvanizing bath. The coated tubing is promptly cooled by a prequench flow of cooling water flowing in the direction of movement of the tubing, thus superficially hardening the zinc. Water is pumped into the prequench zone through passageways arranged radial to the tubing and at an angle between 20° and 40° to the direction of movement. Final cooling is effected by immersion in a water bath. Heavier and smoother zinc coatings can be applied as a result.

10 Claims, 4 Drawing Figures

ACCUM-ULATOR
TUBE FORMER
WELDER
CLEANING STATION
HEATING STATION
GALVAN-IZING
PRE-QUENCH
COOLING BATH

PREQUENCH COOLING FOR GALVANIZED TUBING

This invention relates to the continuous forming and coating of tubing, and more particularly to forming steel tubing from strip steel stock and providing a galvanized coating on the exterior of the tubing.

It is well known to produce endless lengths of welded steel tubing from strip stock and to continuously galvanize that tubing by providing a zinc coating on the exterior surface as taught, for example, in U.S. Pats. Nos. 3,122,144, 3,230,615 and 3,965,551, which are owned by the assignee of this patent application. The present invention improves upon such galvanizing operations by providing an improved cooling arrangement for setting the hot zinc coating. Employment of the invention permits the achievement of smooth exterior surfaces at high speed operation even when relatively heavy coatings of zinc are applied.

The present invention achieves its objectives by employing a co-current flow prequench device in combination with a water bath wherein the zinc-coated tubing is subsequently immersed.

The invention will be understood from the following detailed description of a tubing production line embodying various features of the invention, particularly when read in conjunction with the appended drawings wherein.

Figures 1, 2, 3, 4:
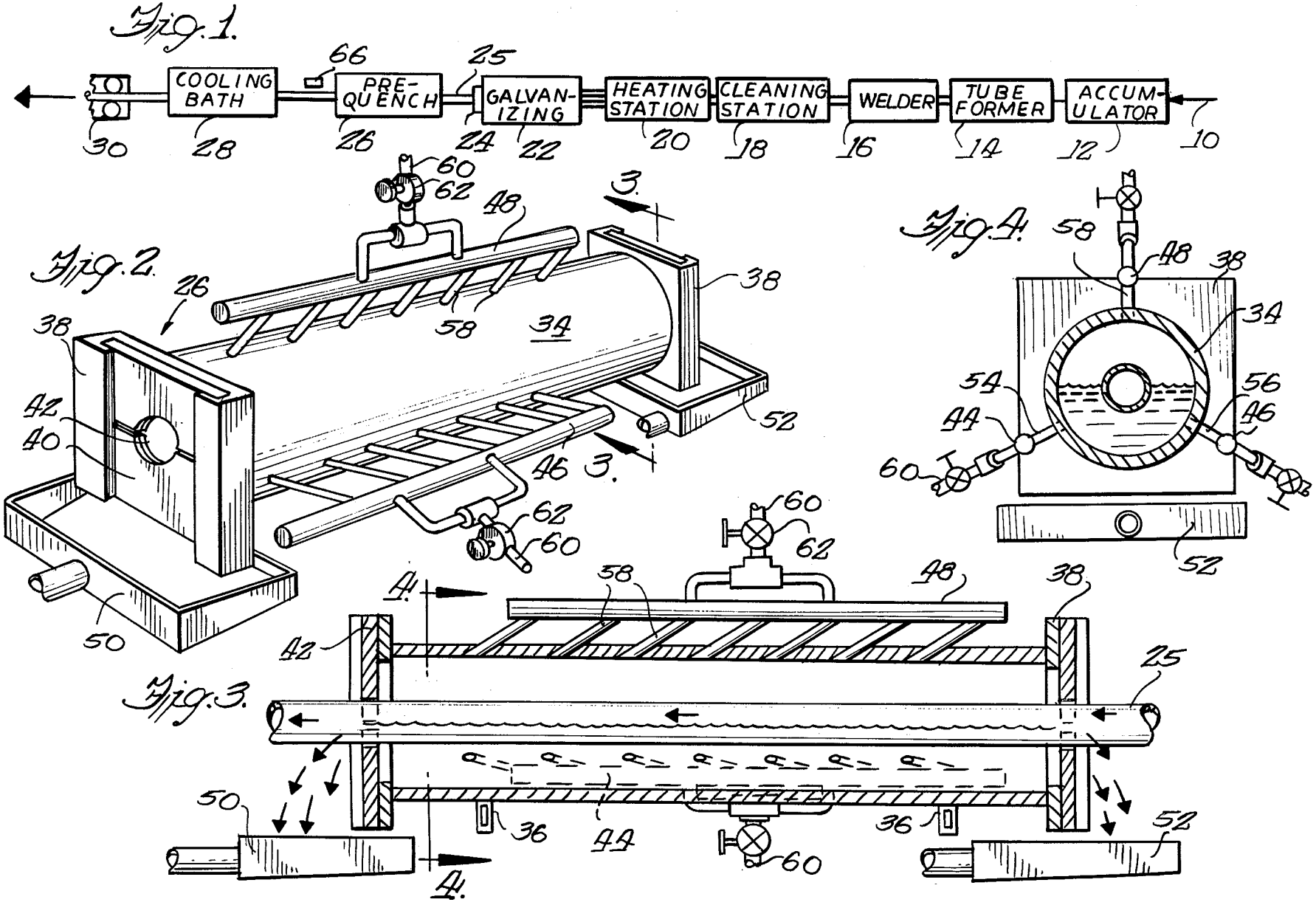
FIG. 1 illustrates a diagrammatic view of a production line arrangement for making lengths of coated steel tubing embodying various features of the present invention through the stages of the continuous forming and galvanizing.
FIG. 2 is a perspective view of the prequench station shown in FIG. 1.
FIG. 3 is a side view with portions broken away taken generally along line 3—3 of FIG. 2 and depicted in operating condition.
FIG. 4 is a sectional view enlarged in size taken generally along lines 4—4 of FIG. 3.

Apparatus embodying various features of the invention is illustrated in FIG. 1 wherein the stations are shown diagrammatically. A detailed description of the strip supply, tube forming, welding, cleaning, heating and galvanizing stations is found in the aforementioned U.S. patents. Although the term "galvanizing" is used herein, this term is employed in its broadest sense and is not intended to be restricted to the employment of pure zinc as the coating material, as for example, an alloy of zinc and aluminum could be used or any other suitable "hot-dip" metal coating composition might be used.

Overall, FIG. 1 depicts a production line in which steel strip 10 which is being formed into tubing moves from right to left. At the upper right-hand corner, strip 10 is depicted which is being supplied from a suitable roll source (not shown). The strip 10 travels past an end welder, which is known in the art, for splicing an end of one roll to another roll at the required time, and it enters an accumulator 12 wherein a sufficient length of the strip is stored to supply the production line while ends of rolls are being welded together. Likewise, the edges of the strip 10 may be appropriately treated so as to be ready for welding at the time the strip 10 enters a tube former 14. The tube former 14 is constituted by a series of conventional forming rolls which continuously deform the strip from its initial flat character to that of a rounded tube, with the edges of the strip in approximately abutting relation to form the seam of the tube upon welding.

The continuous tubular form created by the tube former advances directly to a welder 16 which joins the edges of the strip, preferably using a continuous resistance welding device that is designed to keep the upset on the inside of the formed tubing at a minimum. After welding, scarfing of the outer surface in the welded region is effected, and the tubing is passed to a washing and pickling station 18 where cleaning and removal of oxides occur. This station may include an alkali wash for removing grease from the surface of the tubing, followed by rinsing and an acid treatment for pickling the surface, followed by a further rinse, all of which are well known in the art and described in the earlier-mentioned patents.

Following the cleaning station 18, the tubing passes to a heating station 20 which is located just prior to a galvanizing tank 22. The heating station preferably uses induction heating, although other types of heating can be employed, to bring the tubing up to the desired temperature prior to its entry into the galvanizing tank 22. In order to guard against oxidation of the cleaned tubing, an inert or nonoxidizing atmosphere, for example nitrogen, is used to surround the tubing from the time at which it enters the heating station 20 until it passes to the zinc tank 22.

The tubing is preferably preheated to a temperature above the melting point of the molten galvanizing material, and the continuously moving heated tubing will pick up a uniform coating of zinc as it passes through the tank 22. An air ring 24 is provided adjacent the exit from the galvanizing tank 22 which wipes the excess zinc from the tubing, and the amount of air pressure applied to the air ring can be used to determine the thickness of the zinc coating on the tubing. About three to six feet downstream from the air ring 24, the continuously moving coated tubing 25 enters a prequench station or zone 26 where the outer surface of the zinc coating is superficially set. Thereafter, the tubing enters a liquid cooling bath 28 where it is immersed in a coolant, such as water at a temperature sufficiently low so as to substantially complete the solidification of the zinc and render the coated tubing susceptible to being readily processed thereafter without damage to the galvanized surface. Following zinc solidification, the tubing enters sizing and straightening rolls 30, and thereafter it can be subjected to further coating treatments as described in the aforementioned patents, if desired, before finally being cut to the desired tubing lengths. Although water is the preferred coolant and is referred to throughout the specification, other suitable liquid coolants may be used, as for example, aqueous solutions or high-boiling point organic materials, including oils, in either or both of the cooling locations.

Previously, it has been difficult to obtain a uniform thickness of zinc coating about the tubing, generally because of the effect of gravity, and it has also been difficult to maintain smoothness of the outer surface when applying relatively high zinc weight, for example, 0.6 ounces or more of zinc per square foot. The employment of the prequench station 26 obviates these difficulties and provides substantially smooth, uniform galvanized tubing even when the zinc coating is applied at 0.8 ounces or more of zinc per square foot.

The prequench station 26 includes a tubular enclosure 34 which is circular in cross section and which is disposed horizontally so as to be coaxial with the axis of the continuously moving tubing 25 by a pair of supports 36 intermediate its ends. The tubular enclosure 34 is closed at both ends by slotted end blocks 38 which are open at the top and are designed to receive removable split inserts 40. The inserts 40 each have a central aperture 42 of a different size, and they are interchangeable depending upon the diameter of tubing which is being formed and galvanized. Although the tubular enclosure 34 is suitably attached, as by welding, to the end blocks 38 to provide a watertight fitting, water will necessarily overflow through the central aperture 42 in the clearance region between the circular edge of the split insert and the surface of the continuously moving tubing 25.

The advantageous results from the prequench station 26 are achieved by creating a flow of water within the prequench zone which is in the same direction as the movement of the tubing 25. In this respect, the water is supplied via three headers 44,46 and 48, being pumped from a coolant reservoir (not shown). The water which overflows from the end blocks 38 is caught in collectors 50 and 52 and returned to the coolant reservoir. The headers each respectively feed a plurality of passageways 54,56 and 58, which passageways are all oriented generally radially (see FIG. 4) to the axis of the moving tube 25 but, as best seen in FIG. 3, at an angle of about 30° to the horizontal. The header-passageway networks may be individually fabricated from pipe or tubing as illustrated. However, it may be more practical to simply machine the passageway network from a solid block which can be inserted into a milled slot in the tubular enclosure, and which is considered to be the equivalent thereof. The discharge openings of the passageways 54,56 and 58 are preferably spaced about 6 to 8 inches apart along the three parallel lines. As best seen in FIG. 4, the header 48 is located vertically above the axis, and the headers 44 and 46 are at 120° intervals therefrom.

Supply lines 60 leading to the headers from the cooling water pump each include an adjustable valve 62 which can be used to vary the rate of flow of water through the header. Adjustments in the water flow rate are employed to achieve the desired effect of a smooth, uniform coating. The total flow rate of water is regulated so as to maintain at least about the bottom one-half of the tubing 25 below the water line, as seen in FIGS. 3 and 4, and preferably the flow rate, in combination of course with the extent of the overflow clearance at the end blocks, is not such as to completely submerge the tubing.

It has been found that by orienting the passageways 54,56,58 at an angle of between 20° and 40° to the horizontal, i.e., the axis of the moving tubing 25, a flow pattern of cooling water co-current with the movement of the tubing is established which is exemplified by the overflow pattern which occurs. Preferably, the amount of overflow of cooling water from the downstream end block should be more than twice the overflow from the upstream end block. The temperature of the water which is used is preferably maintained between about 60° F. and 120° F., and a similar water temperature is maintained in the final cooling bath 28. However, somewhat higher or lower quench temperatures can be used, and if coolants other than water are employed, temperatures outside the preferred range might be chosen. The length of the prequench station 26 need not be greater than about one-half the length of the water bath 28, and it is usually shorter than one-third the length and performs effectively.

Generally, the flow through the headers 44 and 46 is maintained at about an equal rate, whereas the flow through the upper header 48 may be at a far lesser rate. In some instances, satisfactory operation at the designated half-full level can be achieved without the use of the upper header. Inasmuch as the tubing 25 exiting the galvanizing bath will be at a temperature between about 790° F. and 950° F., differential exposure to the relatively cold water could cause differential contraction and bowing of the tubing to occur in a particular direction. Accordingly, the path of the moving tubing 25 downstream of the prequench zone 26 is monitored by a suitable spatial monitor 66 of a type known in the art, and adjustments, if necessary, are made to the respective valves 62 to counteract any bowing that may occur.

It has been found that the employment of this prequench station 26, wherein both the cooling water and the molten zinc surface are moving in the same direction, causes minimal disturbance of the zinc surface. As a result, a "superficial skin" of the zinc coating is frozen before the coated tubing 25 enters the main cooling bath 28 with its essentially static body of cooling water. This superficial solidification at the surface not only assures the zinc surface's freedom from distortion, but it counteracts the effect of gravity upon the otherwise still molten zinc material which has the tendency to flow downward to the tubing undersurface, viz., it tries to attain a cross-sectional shape generally resembling a teardrop. The superficial freezing effectively counteracts this tendency and thus provides overall zinc coating uniformity. While these advantages become most apparent when tubing specifications call for a somewhat heavier coating of zinc, for example in the range of about 0.6 to about 0.9 ounce per square foot, improvements in uniformity appear at substantially all commercial coating thicknesses. The appreciation of the improvements is further enhanced when considered in the environment of production-line circumstances where the tubing is running at a speed, for example, of 100 to 500 feet per minute.

As an example, a line for making galvanized steel tubing having an outer diameter of about 1.315 inch and a zinc coating of about 0.9 ounce per square foot is operated at a speed of about 375 feet per minute. Under such circumstances, the coated steel tubing 25 exiting the galvanizing tank 22 may have a temperature of about 850° F., and the air ring 24 is set so as to apply a zinc coating of about 0.9 ounce per square foot. The tubing then enters the prequench zone which is a tubular enclosure 34 about 3½ feet long and having an inner diameter of about 6 inches. Three headers are employed at 120° intervals, as illustrated in the drawings, and each of the headers feeds seven passageways which are about ¼ inch in inner diameter. An equal flow rate of water is maintained throughout the lower two headers 44,46 and the flow rate through the upper header 48 is about 10 percent of the lower header flow rate. The cooling water inlet temperature is maintained at about 90° F. plus or minus about 30°, and the total flow rate of water pumped into the prequench zone 26 is about 20 gallons per minute. About 15 feet downstream from the prequench zone, the tubing 25 is totally immersed as it passes through a water bath about 15 feet long where a temperature of about 90° F. ±30° is also maintained. Water is pumped into the bath at about its center, but only enough flow is utilized to keep the temperature within the desired range so the bath is a substantially static body except at the overflow openings at each end.

Examination of the cooled galvanized tubing shows that the outer surface is extremely smooth, and measuring of the coating thickness shows that it is very uniform about the entire circumference of the tube. Without changing any of the operating parameters of the tube mill, the flow of water to the prequench cell 26 is halted so that the water quickly drains through the apertures 42 to a level below the continuously moving galvanized tubing 25. Examination of the galvanized tubing shows that its character immediately changes and that the bottom surface exhibits a ripple effect. Moreover, close examination shows that the thickness of the zinc coating is greater at the bottom of the tube than in the upper regions. It is believed that the turbulent flow which is created as the rapidly moving zinc-coated tubing 25 enters the cooling bath 28 distorts the smoothness of the zinc which is still in the molten state and that without the prequench station the zinc gravitates downward on the outer wall of the tubing creating the nonuniformity in coating thickness. The advantages of employment of the prequench cell 26 in combination with the subsequent essentially static cooling bath 28 are thus clearly demonstrated.

Although the invention has been described with respect to a preferred embodiment, it should be understood that various changes and modifications as would be obvious to one having the ordinary skill in this art may be made without departing from the scope of the invention which is defined solely by the claims appended hereto. Various of the features of the invention are set forth in the claims which follow.

What is claimed is:

1. A method for galvanizing a continuous length of steel tubing be continuously supply steel strip, roll-forming said strip into tubular shape, welding a seam along said rolled strip and applying a zinc coating to said welded strip in a galvanizing bath as said tubing moves continuously horizontally therethrough, wherein the improvement comprises subjecting at least about the bottom half of said coated tubing without completely submerging said tubing to a prequench flow of liquid coolant very shortly after its exit from said galvanizing bath, said prequenching being carried out by flowing a coolant stream in the direction of movement of said tubing to superficially harden said zinc coating, and then cooling said prequenched coating by immersion in a coolant bath.

2. A method in accordance with claim 1 wherein said coolant is supplied to said prequench zone through a plurality of passageways arranged radial to said moving tubing and at an angle between about 20° and about 40° to said direction of movement thereof.

3. A method in accordance with claim 2 wherein at least about ⅔ of said liquid coolant supplied to said prequench zone overflows from the downstream end of said zone.

4. A method in accordance with claim 1 wherein the temperature of said coolant being supplied to said prequench zone is between about 60° F. and about 120° F.

5. A method in accordance with claim 4 wherein said prequench zone has a length not greater than about one-half the length of said coolant bath.

6. A method in accordance with claim 1 wherein air is directed against the circumference of said tubing as it exits from said galvanizing bath to control the zinc coating so that at least about 0.6 pound per square foot is coated onto said tubing.

7. Apparatus for galvanizing a continuous length of steel tubing, which apparatus includes means for continuously supplying steel strip, means for roll-forming said strip into tubular shape, means for welding a seam along said rolled strip, a galvanizing bath for applying a zinc coating to the exterior surface of said welded tubing as it moves continuously generally horizontally therethrough and means for cooling said zinc coating to produce a substantially smooth outer surface, wherein the improvement comprises said cooling means including a prequench station in combination with a downstream coolant bath, said prequench station being located near the exit from said galvanizing bath and including means for flowing liquid coolant in the direction of movement of said tubing and so as to contact at least about the bottom half of said coated tubing without completely submerging said tubing to superficially harden said zinc coating, and said coolant bath being positioned so as to totally immerse said coated tubing.

8. Apparatus in accordance with claim 7 wherein said prequench station includes a plurality of passageways arranged radial to said moving tubing and at an angle between about 20° and about 40° to said direction of movement thereof and means for pumping liquid coolant through said passageways.

9. Apparatus in accordance with claim 8 wherein said prequench station has a length not greater than about one-half the length of said coolant bath.

10. Apparatus in accordance with claim 7 wherein said plurality of passageways are connected to a plurality of headers which are arranged generally parallel to said tubing and at different locations above and below the level of said tubing, and wherein means is associated with each of said headers for adjustably controlling the rate at which liquid coolant is pumped therethrough.

* * * * *

UNITED STATES PATENT AND TRADEMARK OFFICE

CERTIFICATE OF CORRECTION

PATENT NO. : 4,124,932

DATED : November 14, 1978

INVENTOR(S) : Rogove, et al.

It is certified that error appears in the above-identified patent and that said Letters Patent are hereby corrected as shown below:

Column 6, line 14: "pound" should be --ounce--.

Signed and Sealed this

*Seventeenth* Day of *July 1979*

[SEAL]

*Attest:*

LUTRELLE F. PARKER

*Attesting Officer* *Acting Commissioner of Patents and Trademarks*